US006405504B1

(12) United States Patent
Richardson

(10) Patent No.: US 6,405,504 B1
(45) Date of Patent: Jun. 18, 2002

(54) STRUCTURAL FRAME MEMBERS

(75) Inventor: Christopher Richardson, Clitheroe (GB)

(73) Assignee: Ultraframe (UK) Limited, Clitheroe (GB)

( * ) Notice: Subject to any disclaimer, the term of this patent is extended or adjusted under 35 U.S.C. 154(b) by 0 days.

(21) Appl. No.: 09/244,679

(22) Filed: Feb. 4, 1999

(30) Foreign Application Priority Data

Dec. 22, 1998 (GB) ..... 9828271

(51) Int. Cl.[7] ..... E06B 3/64

(52) U.S. Cl. ..... 52/461; 52/730.4; 52/734.1; 52/780

(58) Field of Search ..... 52/730.3, 730.4, 52/730.5, 730.6, 731.3, 732.2, 734.1, 734.2, 632, 211, 212, 204.53, 204.54, 207.71, 780, 461

(56) References Cited

U.S. PATENT DOCUMENTS 3,248,833 A * 5/1966 Sklar ..... 52/211
3,878,660 A * 4/1975 Jacob ..... 52/730.5
4,546,889 A * 10/1985 Schoumaker et al. ..... 52/632
4,750,310 A * 6/1988 Holcombe ..... 52/731.3
5,323,578 A * 6/1994 Chagnon et al. ..... 52/426
5,540,019 A * 7/1996 Beske et al. ..... 52/204.5
5,570,548 A * 11/1996 Hopper ..... 52/731.3
6,314,691 B1 * 11/2001 Takagi et al. ..... 52/204.53

FOREIGN PATENT DOCUMENTS

DE 2741905 * 3/1979

* cited by examiner

*Primary Examiner*—Michael Safavi
(74) *Attorney, Agent, or Firm*—Wood, Phillips, Katz, Clark & Mortimer

(57) ABSTRACT

A structural frame member that has two parts connected by at least one collapsible part, whereby the two parts can be drawn towards each other to trap an item between spaced formations extending from sides of said parts. The collapsible part is formed as a collapsible web connected to respective ends of the sidewalls of the two parts. Cover strips are pressed into place at the end of each part to cover the juncture between the parts and the item trapped between the spaced formations.

15 Claims, 2 Drawing Sheets

STRUCTURAL FRAME MEMBERS

This invention concerns structural frame members and is particularly concerned with structural frame members as mullions for supporting window frames.

An object of this invention is to provide structural frame members for forming frameworks that can retain, for example, window frames or door frames.

According to this invention there is provided a structural frame member that has two parts connected by at least one collapsible part, whereby the two parts can be drawn towards each other to trap another item between spaced formations extending from sides of said parts, preferably to trap items on both sides of the frame member between spaced formations extending from both sides of said parts.

The two parts are preferably connected by a pair of collapsible webs and one part preferably has an end formation that fits within the other part when they are collapsed together, said parts overlapping to a certain extent, which preferably has a limit.

The spaced extending formations are preferably flanges and they may be flat or shaped. For items that have channel formations extending from their sides, the formations of the structural member may also be channel sections or other complementary formations to mate therewith. The flanges may be shaped for gripping, such as by having a serrated or otherwise uneven surface or may be L-shaped to fit into channel formations of the item to be trapped.

In a preferred embodiment of the invention, the structural frame member comprises a major part having side walls connected by a pair of spaced webs inwards from ends of the side walls and a minor part having side walls connected by a web, the two parts being connected by a pair of collapsible webs each between a pair of aligned sides of each part, whereby in an uncollapsed state items can be positioned against opposite sides of the member and in a collapsed state trapped between outwardly extending formations of the major and minor parts of the member.

Two parts of the structural member of the invention preferably each have means for retaining a cover strip for extending along either side of the structural member to cover the joints with the trapped items. Preferably inner surfaces of the sides of the structural member have formations thereon, such as ribs or the like for retaining cooperating formations of said cover strips.

The cover strips may be single walled or more preferably are twin-walled especially forming multiple ducts for insulation purposes. Edges of the cover strips preferably retain gasket material or have coextruded gasket material therealong.

The structural frame members are particularly suitable for use on mullions in forming a framework to receive window frames. The framework preferably includes a base member and a top member, such as an eaves beam. For securing top and bottom members to the structural members, webs of the structural members are preferably formed with screw ports to receive screws through the top and bottom members respectively into the structural members.

To collapse a structural member of the invention to trap items, such as window frames therein, the two parts may be drawn together by means of screws through a web of one part into a web of the other part.

The invention further comprehends a glazed structure having a framework comprising structural members of the invention with window frames mounted therebetween and trapped along sides thereof between collapsed parts of said structural members.

The structural members used on the invention may be of any suitable material. Aluminium and uPVC are preferred materials, although in the case of uPVC strengthening members, such as of aluminum or steel may be required. Such strengthening members may be moulded into one or both parts of the structural member or may be shaped to fit channels or ducts therein.

This invention will now be further described by way of example only, with reference to the accompanying drawings in which.

Figure 2:
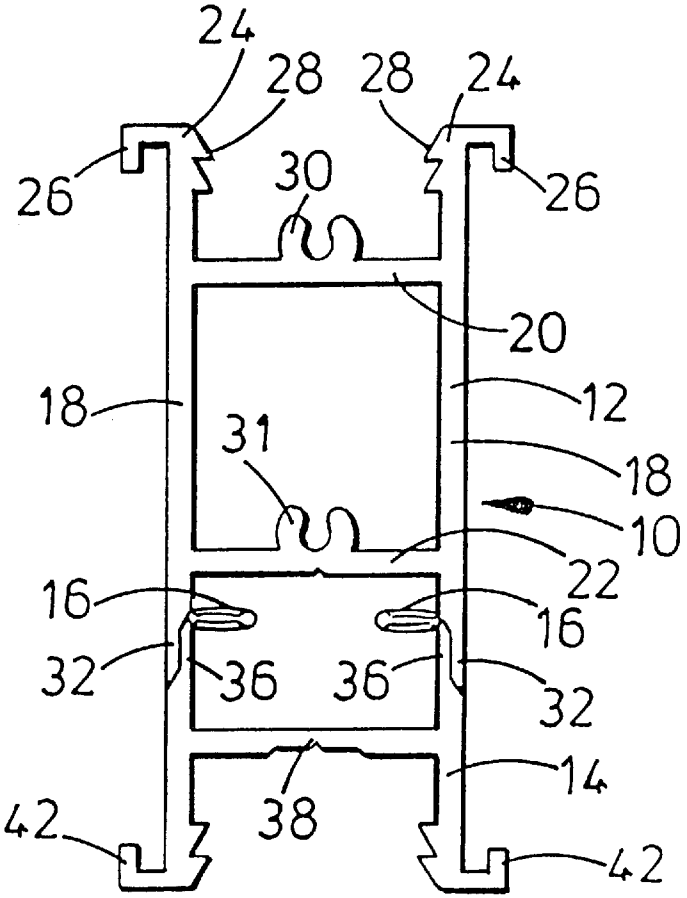
FIG. 2 shows the structural member of FIG. 1 in collapsed form.
Figure 1:
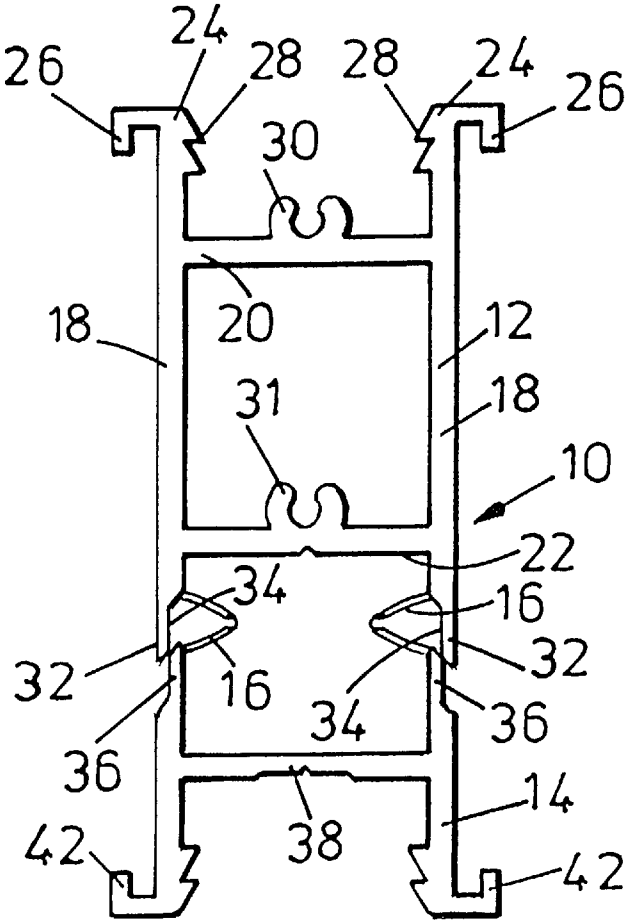
FIG. 1 is an end view of a first structural member according to the invention in uncollapsed form.

Referring to the accompanying drawings, a structural frame member 10 comprises two parts 12, 14 connected by collapsible webs 16. The first part 12 has sides 18 connected by webs 20, 22 spaced inwardly from ends of the sides 18. Outer ends 24 have extending outwardly L-shaped flanges 26 forming channels open oppositely to the ends. Internally of the ends 24 are notches 28. The outermost web 20 has a screw port 30 and the innermost web 22 a screw port 31.

Opposite ends 32 of the sides 18 are rebated at 34. Just prior to the rebates one end of each of the collapsible webs 16 is connected and the other ends of the collapsible webs are connected to ends of the side walls 36 of the second part 14 of the frame member 10.

The second part 14 has its side walls 36 connected by a web 38. Outer ends of the side walls 36 have extending outwardly L-shaped flanges 42 that form channels open towards the flanges 26 of the first part 12 of the structural frame member. Inwardly of the ends of the side walls 36 are notches 44, inner ends of the side walls 36 are rebated on their outside to complement the rebates of the ends 32 of the sides 18 of the first part 12 of the member 10.

Figure 4:
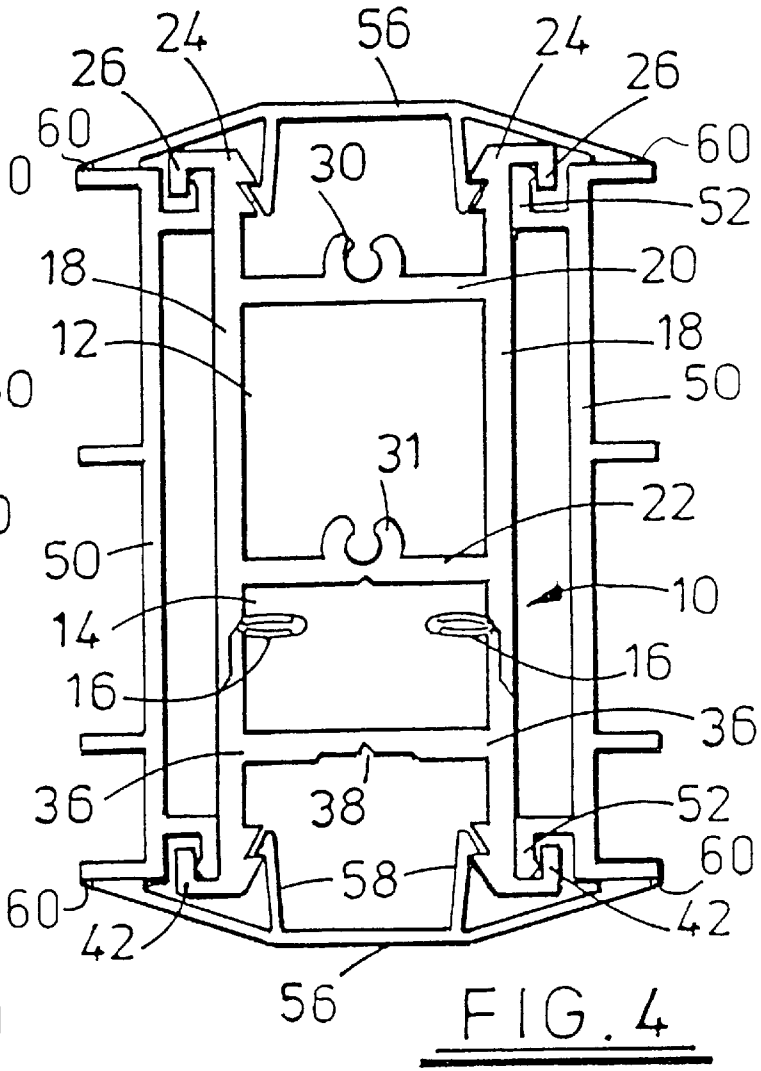
FIG. 4 shows a window frame connected to the structural member of FIG. 1 and 2.
Figure 3:
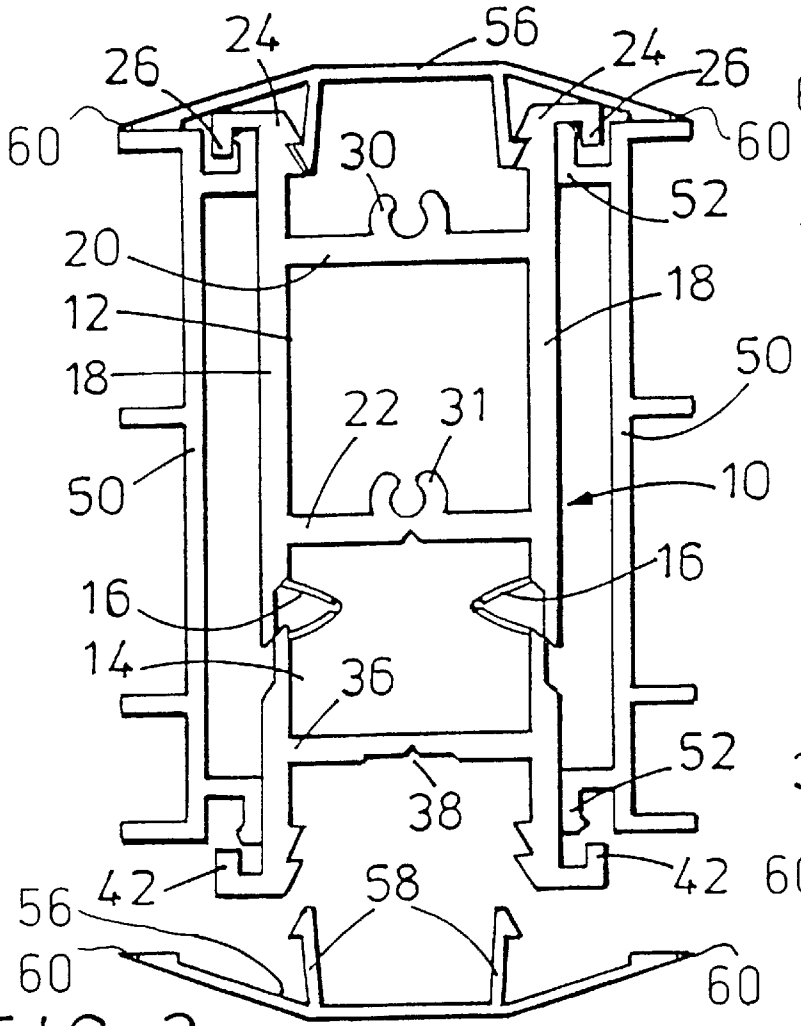
FIG. 3 shows a first stage of connecting window frames to a structural member of FIG. 1 and 2.

The member 10 is designed to be collapsed (as shown in FIG. 2) to trap window frame sides 50 (see FIGS. 3 and 4) between respective pairs of flanges 26 and 42 on opposite sides of the member 10. Conveniently the window frame sides have L-shaped projections 52 that fit the channels formed by the flanges 26 and 42. The structural member 10 is collapsed by screwing through the web 38 of the second part 14 into the web 22 of the first part to draw the webs towards each other. As that occurs the webs 16 collapse to trap the window frame sides between gripping surfaces of the pairs of flanges 26,42. Afterwards cover strips 56 are pressed into place on the end of the member 10 to cover the joints with the window frames, in other words, to cover the junctures between the parts 12, 14, and the window frames. The cover strips 56 have a pair of projections 58 that are shaped at their ends to pass over the notches 28 or 44 of the structural member side walls and be retained by them. Along each side of the cover strips, coextruded gasket material 60 can be provided for sealing against the window frames.

The frame members 10 are intended to be incorporated into a framework comprising an eaves beam and a bottom beam, each of which may be secured to the member 10 by means of screws therethrough into the screw ports 30 and 31.

An advantage of the frame members of the invention is that the window frames can be installed pre-glazed because no fixings have to be used through the window frame sides into the structural frame members.

What is claimed is:

1. A glazed structure having a framework comprising at least a pair of structural frame members spaced apart, each said member having two parts connected by at least one collapsible part, which remains connected to the two parts so that the two parts remain connected to each other through said at least one collapsible part whether collapsed or not collapsed, each said member having spaced formations extending from sides of said two parts and trapping a window frame therebetween with said at least one collapsible part collapsed, whereby the window frame is held between the two structural frame members.

2. A window framework structure as claimed in claim 1, wherein the at least one collapsible part comprises a pair of collapsible webs.

3. A structural frame member that has two parts connected by at least one collapsible part, which remains connected to the two parts so that the two parts remain connected to each other through said at least one collapsible part whether collapsed or not collapsed, whereby the two parts can be drawn towards each other to trap an item between spaced formations extending from said two parts connected thereby, wherein said parts have opposed sides and spaced formations on both sides, whereby items may be trapped on both sides of the frame member.

4. A structural frame member as claimed in claim 3, wherein the two parts are connected by a a pair of collapsible webs.

5. A structural frame member as claimed in claim 3, wherein the spaced extending formations are flanges.

6. A structural frame member as claimed in claim 5, wherein the flanges are L-shaped.

7. A structural frame member as claimed in claim 5, wherein the flanges each have a gripping surface.

8. A structural frame member comprising a major part having side walls connected by a pair of spaced webs inwards from ends of the side walls and a minor part having side walls connected by a web, the two parts being connected by a pair of collapsible webs each between a pair of aligned sides of each part, each part having outwardly extending formations, whereby in an uncollapsed state items can be positioned against opposite sides of the member and in a collapsed state trapped between outwardly extending formations of the major and minor parts of the member.

9. A structural frame member as claimed in claim 8, wherein the two parts of the structural member each have means for retaining a cover strip, said member having two cover strips, each extending beyond a respective side of the structural member to cover junctures between said parts and an item trapped within said member.

10. A structural frame member as claimed in claim 9, wherein inner surfaces of the sides of the structural frame member have formations thereon for retaining cooperating formations of the cover strips.

11. A structural frame member as claimed in claim 9, wherein the cover strips are single-walled.

12. A structural frame member as claimed in claim 9, wherein edges of the cover strips retain gasket material.

13. A structural frame member as claimed in claim 9, wherein edges of the cover strips have coextruded gasket material therealong.

14. A structural frame member as claimed in claim 8, wherein the webs connecting the side walls of the major and minor parts of the frame member include webs provided with screw ports.

15. A structural frame member that has two parts connected by at least one collapsible part, which remains connected to the two parts so that the two parts remain connected to each other through said at least one collapsible part whether collapsed or not collapsed, whereby the two parts can be drawn towards each other to trap an item between spaced formations extending from said two parts connected thereby, wherein one part has an end formation that fits within the other part when said parts are collapsed together, said parts overlapping to a limited extent.

* * * * *